United States Patent [19]

Ballard

[11] Patent Number: 4,676,762

[45] Date of Patent: Jun. 30, 1987

[54] TOY BUILDING BLOCK KIT AND PIECES THEREOF

[76] Inventor: Larry N. Ballard, 1242 Wintergreen Ter., Batavia, Ill. 60510

[21] Appl. No.: 479,354

[22] Filed: Mar. 28, 1983

[51] Int. Cl.[4] ..... A63H 33/08; A63H 33/12

[52] U.S. Cl. ..... 446/104; 446/122; 446/110; 446/124; 446/127; 446/128

[58] Field of Search ..... 46/19, 20, 23, 24, 25, 46/26, 30, 31; 24/590; 446/122, 102, 104, 105, 108, 110, 111, 120, 124, 127, 128, 93, 95, 118

[56] References Cited

U.S. PATENT DOCUMENTS

| | | | |
|---|---|---|---|
| 2,020,562 | 11/1935 | Miller | 46/23 |
| 2,132,757 | 10/1938 | Paulson | 46/25 |
| 2,208,049 | 7/1940 | Pajeau | 46/31 |
| 2,398,573 | 4/1946 | Becker | 46/25 |
| 2,537,750 | 1/1951 | Gretschel | 24/590 |
| 2,869,692 | 1/1959 | Hasset | 46/31 |
| 3,415,007 | 12/1968 | Höwe | 46/30 |
| 3,420,275 | 1/1969 | Glen et al. | 46/23 |
| 3,516,194 | 6/1970 | Schmidlin | 46/23 |
| 3,623,756 | 11/1971 | Fischer | 46/26 |
| 3,648,404 | 3/1972 | Ogsbury et al. | 46/31 |
| 3,689,075 | 9/1972 | Adelsohn | 46/30 |
| 3,803,754 | 4/1974 | Fischer | 46/26 |
| 3,867,784 | 2/1975 | Lange | 46/26 |
| 4,106,657 | 8/1978 | Dogliotti | 46/25 |
| 4,147,007 | 4/1979 | Eppich | 46/30 |
| 4,171,590 | 10/1979 | Fischer | 46/23 |
| 4,182,072 | 1/1980 | Much | 46/31 |
| 4,258,522 | 3/1981 | Amaral | 46/25 |

*Primary Examiner*—Mickey Yu

*Attorney, Agent, or Firm*—Thomas R. Vigil

[57] ABSTRACT

The toy building block kit includes a variety of buildingblock pieces with a first building block piece (e.g., piece 10, 100, 110, etc.) having on at least one side thereof, a longitudinal slot (20, 102, 112, etc.) and a transverse slot (30, 104, 114, etc.), and a second building block piece (e.g., piece 12, 140, 150, etc.) having on at least one side thereof a rib (60, 130, 142, 152, etc.) extending therefrom sized, configured and dimensioned to be received in one of the slots (20, 102, 112 etc. or 30, 104, 114, etc.) in said first piece.

The pieces can be elongate, rectangular or triangular and each piece has crossing slots (e.g., slots 20, 30) therein forming a waffle or matrix pattern on the various sides thereof.

Also each piece, (e.g., piece 10) may have one or more ribs (e.g., ribs 60) extending from a side thereof for interconnecting with another piece (e.g., piece 12).

Furthermore, a variety of specialty pieces, e.g., flat panel pieces (200 or 400), square or triangular, can be provided for constructing particular structures, e.g., houses (214), automobiles (430), airplanes, ships, etc.

39 Claims, 43 Drawing Figures

FIG. 29
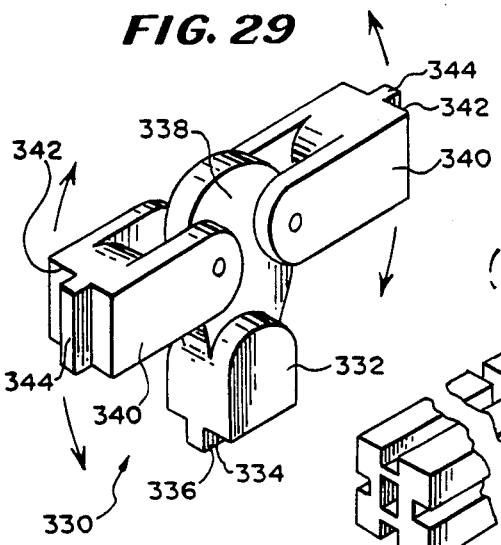
FIG. 30
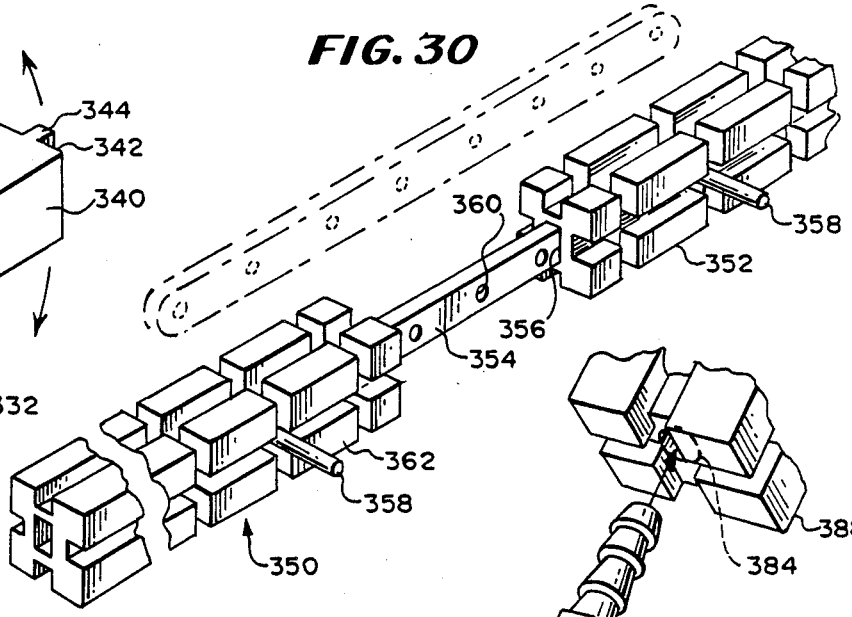
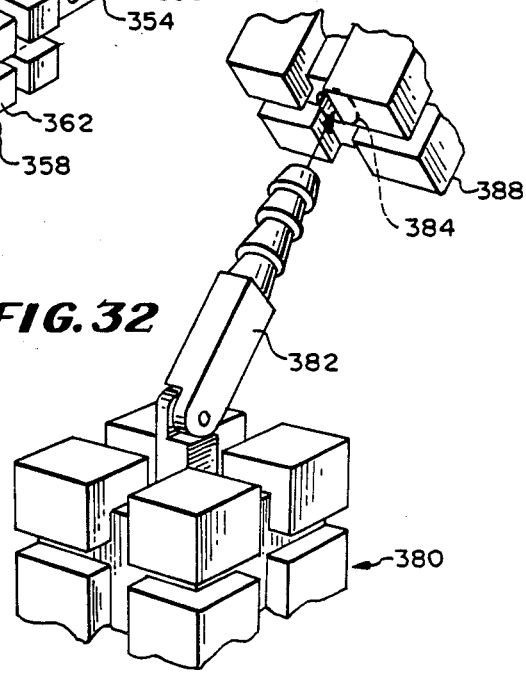
FIG. 32
FIG. 31
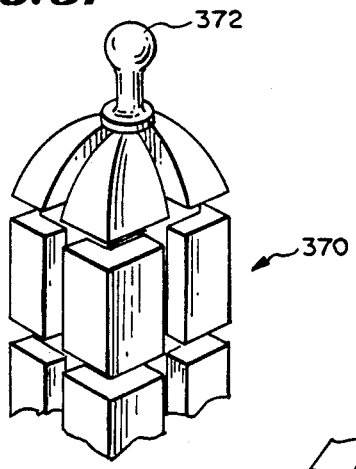
FIG. 33
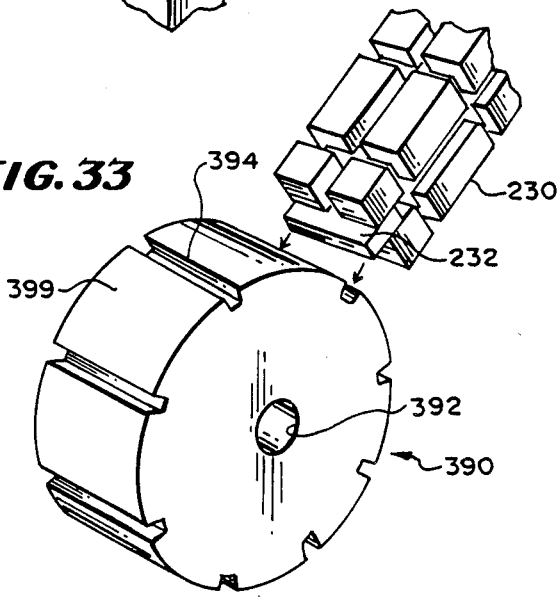
FIG. 34
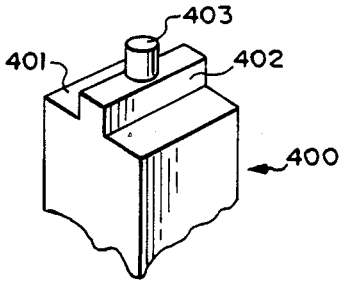

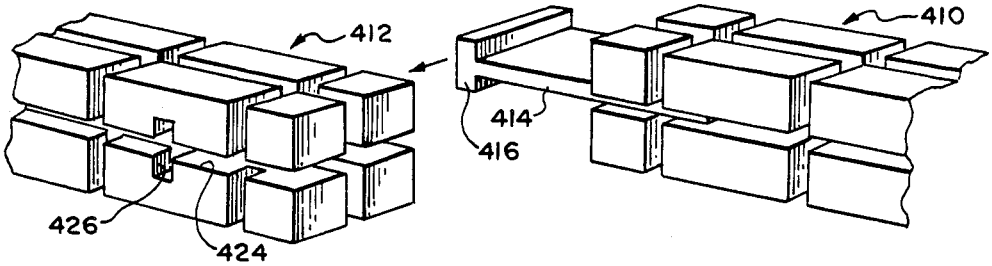
FIG. 35
FIG. 36
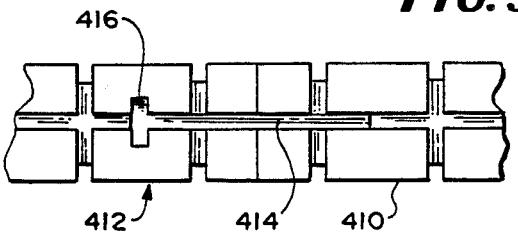
FIG. 37
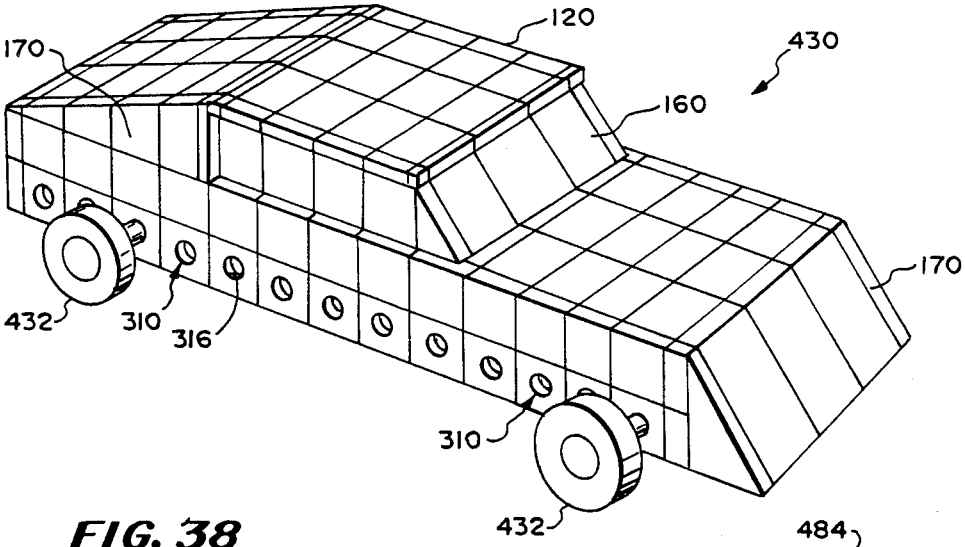
FIG. 38
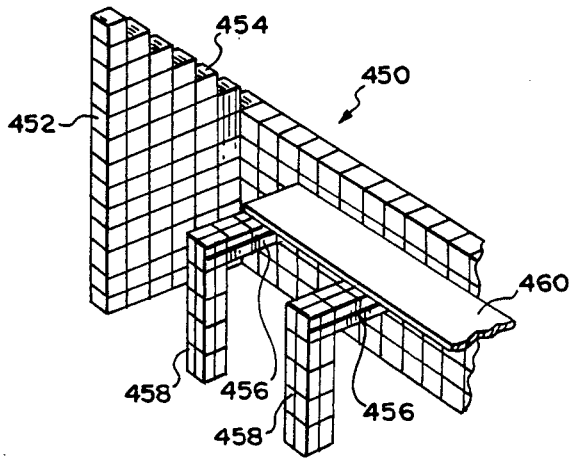
FIG. 39
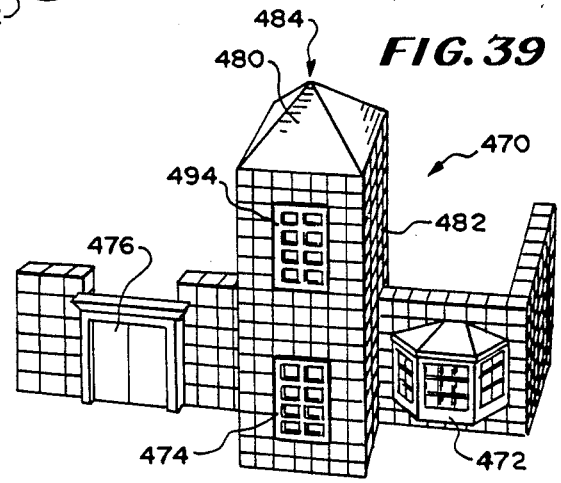

FIG. 40
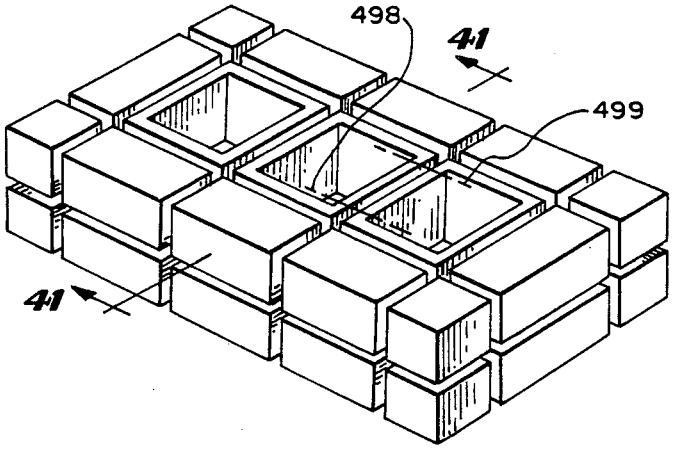
FIG. 41
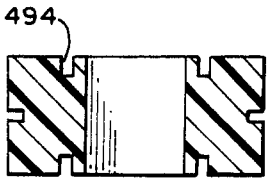
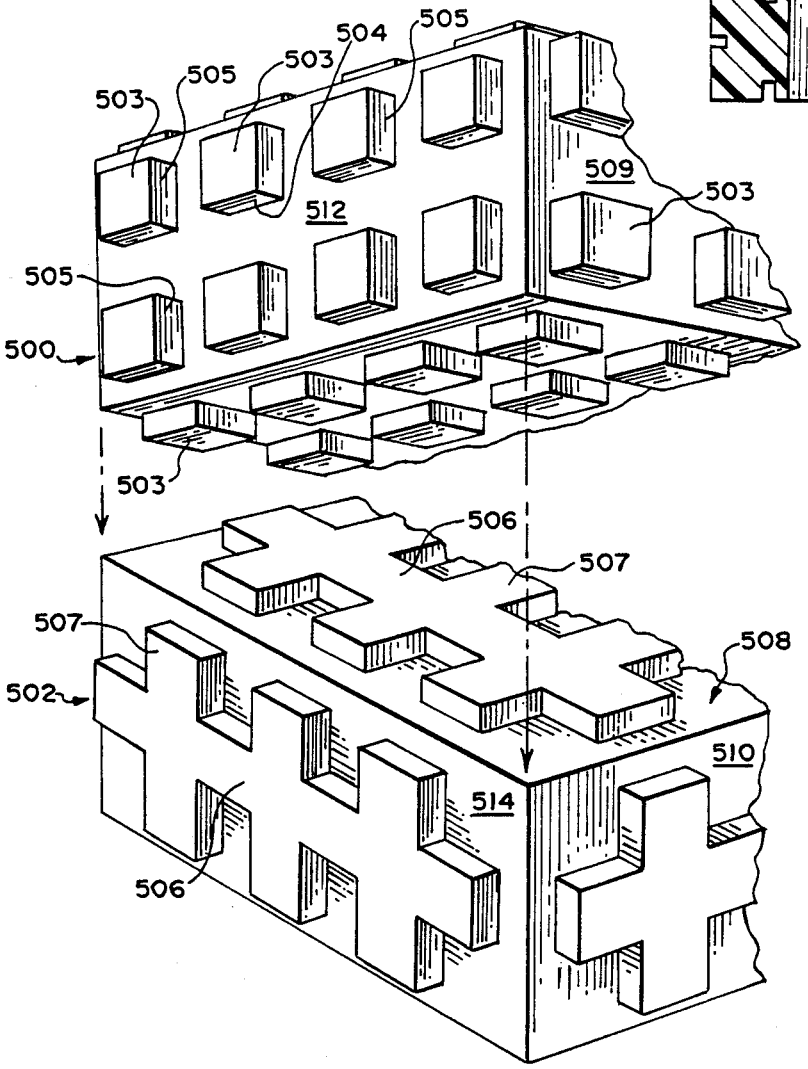
FIG. 42

TOY BUILDING BLOCK KIT AND PIECES THEREOF

BACKGROUND OF THE INVENTION

1. Field of the Invention

The present invention relates to a toy building block kit of the type which has a number of specially configured interlocking pieces each having a basic waffle pattern of slots and/or ribs for interconnecting the pieces together to form various structures.

2. Description of the Prior Art Heretofore various toy building block kits having a variety of interlocking pieces have been proposed and examples of such toy building block kits are disclosed in the following U.S. Patents:

| U.S. PAT. NO. | PATENTEE |
|---|---|
| 570,688 | Stratton |
| 1,174,558 | Friedel |
| 2,810,233 | Jakobsen |
| 2,020,562 | Miller |
| 2,972,833 | La Grutta |
| 3,005,282 | Christiansen |
| 3,034,254 | Christiansen |
| 3,456,413 | Fischer |
| 3,676,969 | Moore |
| 3,699,709 | Schmidt |
| 3,716,939 | Pibet |
| 3,800,494 | Hall et al. |
| 3,987,579 | Palenik, III |
| 4,372,076 | Beck |

The Stratton U.S. Pat. No. 570,688 discloses a toy building block kit comprising blocks and pieces of different shapes, some of which have grooves therein and some of which have tongues for connecting various parts together. The parts, blocks or pieces have a minimal number of slots for interconnecting so that only a limited number of assemblages of the parts can be made with the building block pieces.

In contradistinction and as will be described in greater detail hereinafter, the building block pieces of the present invention are provided with a waffle pattern of slots to provide a wide variety of interconnections between the various building block pieces as opposed to the limited connections available with the blocks disclosed in the Stratton U.S. Pat. No. 570,688.

The Friedel U.S. Pat. No. 1,174,558 discloses building strips for toy structures wherein the strips are preferably made of stiff board material and have a plurality of spaced apart openings or perforations therein for receiving fasteners for constructing various structures. The building strips disclosed in this patent are very similar in shape to the type that are included in the toy building block kit sold under the trademark ERECTOR SET.

The Miller U.S. Pat. No. 2,020,562 discloses toy blocks which have an elongate configuration and which are configured with groove and tongue formations that can interconnect with each other for creating various structures.

The Jakobsen U.S. Pat. No. 2,810,233 discloses toy building elements of the type which are in the form of elongate cylinders with short pins extending therefrom. The interconnection of the building elements in this patent are somewhat similar to the interconnection of pieces in the toy building block kits sold under the trademark LEGO BLOCKS.

The La Grutta U.S. Pat. No. 2,972,233 discloses plastic blocks for forming a plastic block assembly wherein various block pieces have slots therein adapted to snap fittingly receive therein balls at the ends of necks.

The Christiansen U.S. Pat. No. 3,005,282 discloses building block pieces having tubular recesses in which cylindrical projections are received for interconnecting the various pieces. These pieces are of the type that are sold under the trademark LEGO BLOCKS.

The Christiansen U.S. Pat. No. 3,034,254 discloses toy building sets and building blocks included therein which are of the type that have tubular recesses and cylindrical pins which enable one to interconnect various parts into various structures. Again, these building block pieces are of the type sold under the trademark LEGO BLOCKS.

The Fischer U.S. Pat. No. 3,456,413 discloses structural elements having elongate heads on necks receivable in elongate spaces whereby a sliding interconnection can be made between various structural elements.

The Moore U.S. Pat. No. 3,676,969 discloses a log type building unit wherein various log members have tongues with a specially configured cap member or grooved portion for interconnecting the log members.

The Schmidt U.S. Pat. No. 3,699,709 discloses flat rods having circular grooves therein for direct cross connecting with other rods and having perforations in the rods for receiving projections on coupling pieces.

The Pibet U.S. Pat. No. 3,716,939 discloses a toy construction system including similar or identical building elements having cylindrical projections in one side and cylindrical openings on the opposite side for receiving the cylindrical projections on another identical piece.

The Hall et al. U.S. Pat. No. 3,800,494 discloses a connecting structure for logs where each log has a dovetail portion at one end for mating with a dovetail core portion on an adjacent end of another log with a recess in a further log being received over and transverse of the alignment core portions.

The Palenik, III U.S. Pat. No. 3,987,579 discloses a kit type amusement device having a foundation board, building blocks and connector rods. The blocks have cylindrical openings therein for receiving the rods to interconnect the various building block elements.

The Beck U.S. Pat. No. 4,372,076 discloses a modular interlocking block construction toy kit comprising elongated logs which have notches therein much like the log elements sold under the trademark LINCOLN LOGS.

As will be described in greater detail hereinafter, the toy building block kit and the various toy building block pieces thereof differ from the previously proposed toy building block kits and the respective pieces thereof by providing specially configured building block pieces which have a matrix of slots on the various sides thereof with certain of the pieces having ribs at certain locations therein on certain sides thereof extending outwardly therefrom for interconnecting with any one of a number of the slots in the slot matrix on another building block piece.

Also a number of specialty pieces are provided in various toy building block kits for enabling a user thereof to make a variety of constructions, both building type constructions, vehicle type constructions and machine type constructions.

SUMMARY OF THE INVENTION

According to the present invention there is provided for use in a toy building block kit, a first building block piece, having on at least one side thereof, a longitudinal slot and a transverse slot, and a second building block piece having on at least one side thereof a rib extending therefrom sized, configured and dimensioned to be received in one of said slots in said first piece.

The pieces can be elongate, rectangular or triangular and each piece has crossing slots therein forming a waffle or matrix pattern on the various sides thereof.

Also each piece may have one or more ribs extending from a side thereof for interconnecting with another piece.

Furthermore, a variety of specialty pieces, e.g., flat panel pieces, square or triangular, can be provided for constructing particular structures, e.g., houses, automobiles, airplanes, ships, etc.

BRIEF DESCRIPTION OF THE DRAWINGS

FIG. 29 is a perspective view of a three way connecting piece which has a base portion with a rib extending downwardly therefrom and two connecting portions each pivoted to the base portion and each having a rib at an outer end thereof.

FIG. 30 is a fragmentary perspective view of yet another elongate building block piece of a toy building block kit of the present invention in which two portions of the piece are telescopically connected by means of a bar which has apertures therein and which is slidably received within the elongate piece portions and held in place by means of pins.

FIG. 31 is a fragmentary perspective view of the end of another elongate building block piece of a toy building block kit of the present invention wherein a ball for forming a ball joint connection with another elongate piece is provided at one end of the elongate piece.

FIG. 32 is a fragmentary perspective view of the ends of still two other elongate pieces wherein one of the elongate pieces has a pivoted bayonet at one end and the other piece has an axial opening at one end thereof for receiving the bayonet.

FIG. 33 is a perspective view of a cylindrical building block piece having spaced apart axially extending slots on the outer periphery thereof and a fragmentary perspective view of an end of an elongate piece having a rib on the end thereof of the type shown in FIG. 16 positioned to be received in a slot on the cylindrical building block piece.

FIG. 34 is a fragmentary perspective view of the end of another elongate piece where the rib at the end of the elongate piece has a short pin extending therefrom.

FIG. 35 is a fragmentary perspective view of the mating ends of two further elongate building block pieces of a toy building block kit constructed according to the teachings of the present invention wherein one piece has a flat extension which has a T shaped cross section and the other piece has a T shaped slot extending therethrough for laterally receiving the T cross section flat extension of the other piece to connect these pieces together.

FIG. 36 is a fragmentary side view of a connection of the two pieces shown in FIG. 35.

FIG. 37 is a perspective view of an automobile constructed from various building block pieces of a toy building block kit of the present invention with the slots on the pieces shown simply as lines.

FIG. 38 is a fragmentary perspective view of part of a complex building structure constructed with various of the building block pieces of a toy building block kit of the present invention.

FIG. 39 is a fragmentary perspective view of another portion of the complicated building structure shown in FIG. 38.

FIG. 40 is a perspective view of a modified form of a building block piece constructed in accordance with the teachings of the present invention and wherein hollow cavities extend through the building block piece to reduce the amount of material in the building block piece.

FIG. 41 is a sectional view taken through the building block piece shown in FIG. 40 and is taken along line 41—41 of FIG. 40.

FIG. 42 is a fragmentary perspective view of two modified building block pieces constructed in accordance with the teachings of the present invention where one building block piece is formed with a plurality of generally square cross section bosses extending from the side surfaces thereof to form slots therebetween and the other building block piece is provided with a longitudinal rib and a plurality of transverse ribs on either side of and extending from the longitudinal ribs on the sides of the other piece, the ribs being sized to mate with the slots on the one piece.

DESCRIPTION OF THE PREFERRED EMBODIMENTS

Figure 1:
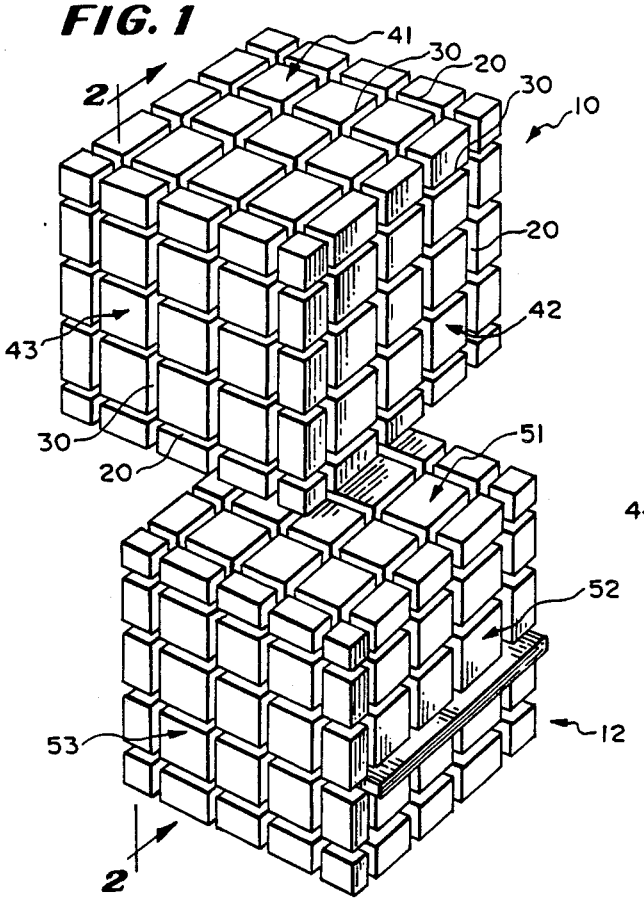
FIG. 1 is a perspective view of two generally cube shaped building block pieces of a toy building block kit of one embodiment of the invention and shows slots in and ribs on the pieces constructed according to the teachings of the present invention for enable the two pieces to be coupled together.

Referring now to the drawings in greater detail there is illustrated in FIG. 1 two generally cube shaped building block pieces 10 and 12 forming part of one toy building block kit of the present invention. It will be appreciated, as the following description of the various building block pieces proceeds, that any one kit made according to the teachings of the present invention can include any number and variety of building block pieces. Each kit will have a number of different pieces and a certain number of each particular piece. In this respect, with reference to the two generally cube shaped building block pieces 10 and 12 shown in FIG. 1, a beginning kit for a young child may consist of 10, 20 or 30 of the building block pieces 10 and 12.

Figure 2:
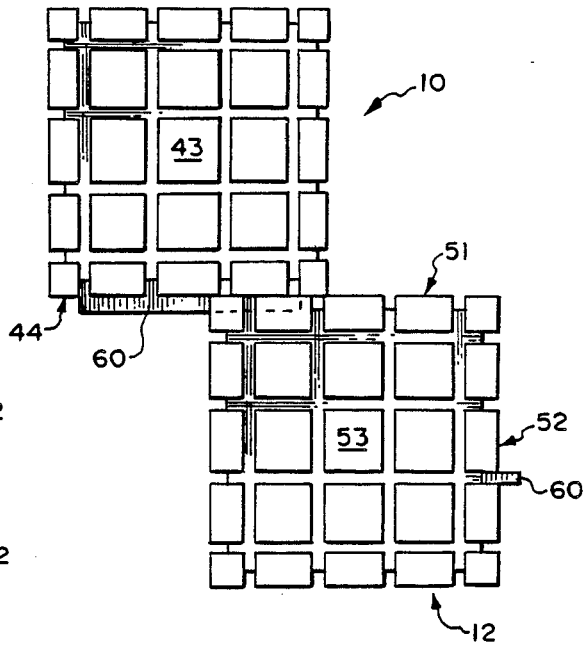
FIG. 2 is a side elevational view of the pieces shown in FIG. 1 as they are brought together into a mating and coupling engagement and is taken along line 2—2 of FIG. 1.
Figure 3:
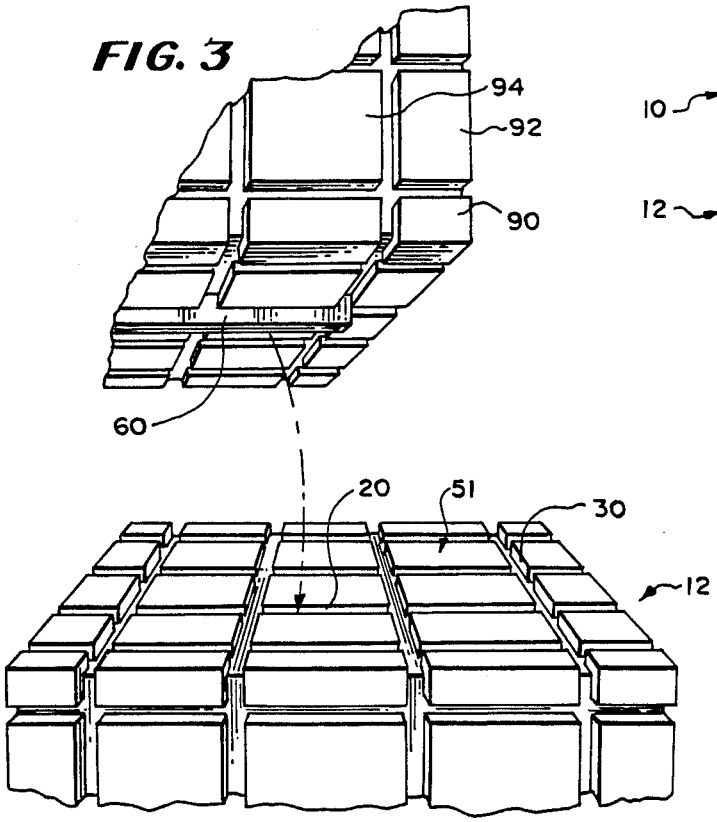
FIG. 3 is a fragmentary perspective view of the two pieces shown in FIG. 1 prior to their interconnection/-mating engagement and shows the rib on one building block piece that is received in a slot on the other building block piece.

As shown in FIGS. 1, 2 and 3, each of the generally cube shaped building block pieces 10 and 12 has a matrix or network of slots 20 formed therein. In particular the pieces shown have four slots 20 extending in one direction and four slots 30 extending in a transverse direction on each side, e.g., sides 41, 42 and 43 on block 10 and sides 51, 52 and 53 on block 12. Then on one side, such as side 52 of building block piece 12, there is provided an elongate rib 60 in one of the slots 20 or 30 which extends outwardly a predetermined distance as shown. Also as shown in FIGS. 2 and 3, a side 44 of the building block piece 10 has a rib 60 in a slot 20 or 30. In this way, each building block piece 10 can be connected to each building block piece 12.

As shown in FIG. 2, the rib 60 on block 10 can be pressed into a slot 20 or 30 in block 12 or can be slid into a slot 20 or 30 on block 12.

Again in FIG. 2, the building block pieces 10 and 12 are shown partially coupled together. Here rib 60 on underside 44 of the building block piece 10 is shown being slid into a slot 20 or 30 on the topside 51 of the building block piece 12.

Turning now to FIG. 3, it will be seen that the rib 60 can be pressed into a slot 20 on the topside 51 of the building block piece 12 as opposed to being slid into the the building block piece 12.

The thickness of the rib 60 on each building block piece 10 or 12 will be equal to or slightly greater than the width of each of the slots 20 or 30 so that a friction fit is established between each rib 60 and each slot 20 or 30 when two building block pieces 10 and 12 are brought together.

Figure 4:
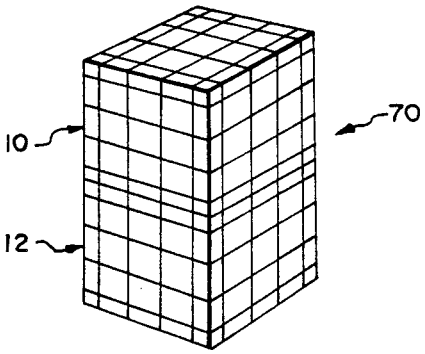
FIG. 4 is a perspective view from a distance of the two building block pieces shown in FIG. 1 connected together in an aligned manner to form a single block the size of two pieces with the slots on the blocks shown as lines.

In FIG. 4 the two building block pieces 10 and 12 are shown coupled togehter in an aligned manner to form a larger rectangular block 70.

Figure 5:
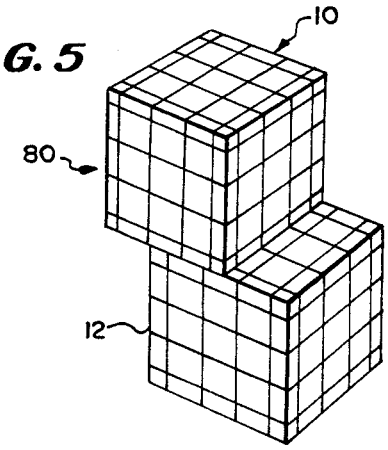
FIG. 5 is a perspective view of two building block pieces shown in FIG. 4 connected in a non-aligned manner.

On the other hand in FIG. 5, the building block pieces 10 and 12 are shown coupled or connected in an offset manner to form an offset configuration generally identified by reference numeral 80 in FIG. 5.

It will be appreciated that the building block pieces 10 and 12 are essentially identical. However, for the sake of description here, they have been given separate reference numerals 10 and 12.

In accordance with the teachings of the present invention a preferred dimension for the slots 20 and 30 is 2/16 inch and, of course, a preferred thickness of the rib 60 is 2/16 inch.

Preferably each of the slots 20 and 30 have a depth into the building block piece 10 or 12 of approximately 2/16 inch. Likewise, each one of the ribs 60 will extend outwardly from a side, e.g., side 44 or 52, of a building block piece 10 or 12 a distance of approximately 2/16 inch.

Also, each cube shaped building block piece 10, 12 has a corner formation 90 with a dimension of approximately 3/16 inch by 3/16 inch on each side thereof. Then an adjacent formation 92 has a dimension of approximately 6/16 inch by 3/16 inch. Finally, between the slots 20 and 30 within the center area of each side 41–44 and 51–53 of the building block pieces 10 and 12 there are a plurality of generally square formations 94.

These square formations 94 between the slots 20 and 30 are each 6/16 inch by 6/16 inch provide each building block piece 10 or 12 on its sides 41–44 and 51–53 with a generally waffle pattern. Stated another way, the slots 20, 30 are formed in the sides 41–44 or 51–53, etc. of the building block pieces 10 and 12 in a matrix pattern. This provides the building block pieces 10 and 12, and the other pieces to be described hereinafter, with a distinct appearance and a distinct function. The waffle pattern provides not only the distinct appearance to the building block pieces of the present invention but also permits a wide variety of couplings or connections to be made between pieces, such as, for example, the connections shown in FIGS. 4 and 5 between the pieces 10 and 12.

Also because of the uniformity in the arrangement and dimensions of the slots 20 and 30, ribs 60 and the block formations 90, 92 and 94, the pieces can be interconnected in a variety of directions to form a variety of structures. Also, the distinctive appearance of the waffle pattern enables the building block pieces to simulate the appearance of bricks for building a building as will become more apparent in connection with the description of FIGS. 13, 14, 38 and 39. For this purpose it may be desirable to have the building block pieces colored red.

Further as will be described in greater detail hereinafter, the building block pieces such as pieces 10 and 12 can be made of a number of different materials with plastic being one preferred material. Also the building block pieces can be made in half sections with hollow cavities on the interior facing portions thereof so that when the sections are secured together such as by a suitable adhesive or solvent bonding, the interior of the building block pieces, e.g., pieces 10 and 12, will be hollow to reduce the amount of material needed for the building block pieces.

Figure 6:
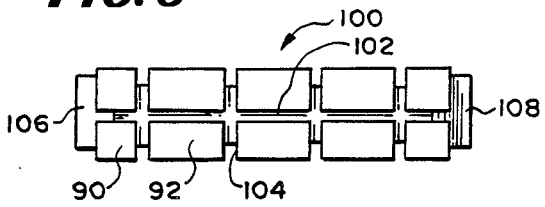
FIG. 6 is a side view of an elongate building block piece having ribs at each end therof and slots therein according to the teachings of the present invention.

Referring now to FIG. 6 there is illustrated therein an elongate building block piece 100 which has one longitudinal slot 102 therein which extends along the length of the building block piece 100 and has four transverse slots 104. These slots 102 and 104 are essentially the same in dimension as the slots 20 and 30 in the blocks 10 and 12 shown in FIGS. 1–5.

Since all of the building block pieces with slots therein will have formations identical to the formations 90, 92 and 94 described with reference to FIG. 3 above, the same reference numerals 90, 92 and 94 will be used to designate similar formations in other building block pieces. Accordingly, it will be apparent that the slots 102 and 104 are arranged and spaced on one side of the building block piece 100 so as to form four formations 90 and six formations 92 thereon.

In addition to the slots 102 and 104, the building block piece 100 has two ribs 106 and 108 at each end. Again, the thickness of each of the ribs 106 and 108 is the same as the thickness of the ribs 60 and the ribs 106 and 108 extend outwardly from the ends of the building block piece the same distance that the rib 60 extends outwardly from a side of one of the building block pieces 10 or 12. Also it will be appreciated that the length of each of the ribs 106 and 108 is less than the width of the building block piece 100.

Figure 7:
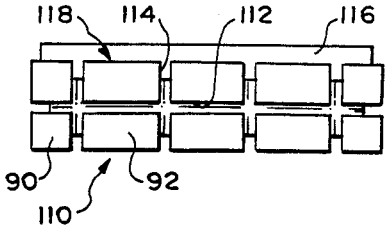
FIG. 7 is a side view of another elongate building block piece which has a rib extending along the top side thereof and with slots therein according to the teachings of the present invention.

In FIG. 7 there is illustrated another elongate building block piece 110 which has a longitudinal slot 113 and four lateral slots 114 on each side thereof, one side being shown. Here again, formations 90 and 92 are formed between the slots 112 and 114. This piece 110 differs from the piece 100 shown in FIG. 6 by having one longitudinal rib 116 inserted into a slot 112 on a top side 118 thereof as opposed to the end ribs 106 and 108 of the piece 100.

Figure 8:
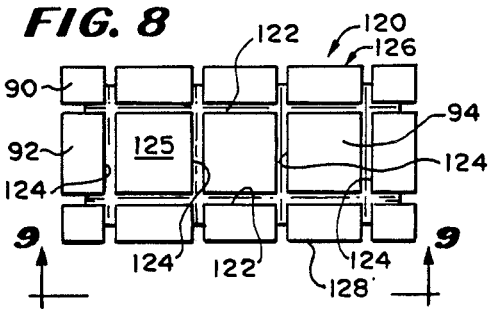
FIG. 8 is a top view of a rectangular building block piece which can be a half piece as shown in FIG. 9.
Figure 9:
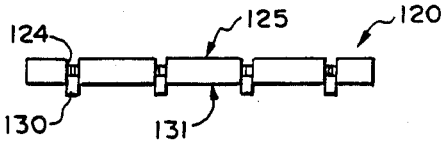
FIG. 9 is a side view of the piece shown in FIG. 8, is taken along line 9—9 of FIG. 8 and shows the building block piece of FIG. 8 constructed as a half piece with ribs on the underside thereof.

FIG. 8 illustrates a rectangular building block piece 120 which has two longitudinal slots 122 and four lateral slots 124 on one side 125 thereof. In this way the side 125 of the building block piece 120 shown in FIG. 8 has four corner formations 90, eight formations 92, and three "square" formations 94. This building block piece 120 can have an opposite side identical to the side shown in FIG. 8 with adjacent opposite sides 126 and 128 that are formed with a configuration as shown in FIG. 6. Alternatively the piece 120 can be a half piece as shown in FIG. 9.

As shown, the piece 120 does not have any ribs thereon. However, if it is formed as a half piece, it will at least have transverse ribs 130 on the side 131 opposite side 125 as shown in FIG. 9. The ribs 130 are positioned opposite the lateral slots 124 and extending laterally of the piece 120. Several such pieces are provided in one kit constructed according to the teachings of the present invention so that when additional ½ thickness of a building block piece is desired, such can be obtained with half piece 120. Such half piece 120 is utilized in, for example, a construction of an automobile 430 as shown in FIG. 37.

Figure 10:
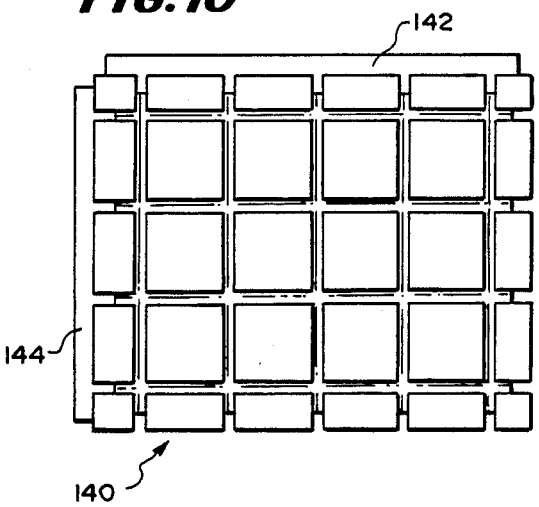
FIG. 10 is a top plan view of another building block piece which is generally rectangular in shape and which has ribs on two adjacent sides thereof and slots therein according to the teachings of the present invention.

In FIG. 10 there is illustrated another building block piece 140 which is generally rectangular having a length of approximately 2 ½ inches and a width of approximately 2 inches with a rib 142 on one long side thereof and a rib 144 on another long side thereof. In other respects, the piece 140 is like the piece 120 made as a full piece and will have a thickness on its sides and configuration on its sides as the sides of piece 100 shown in FIG. 6.

Figure 11:
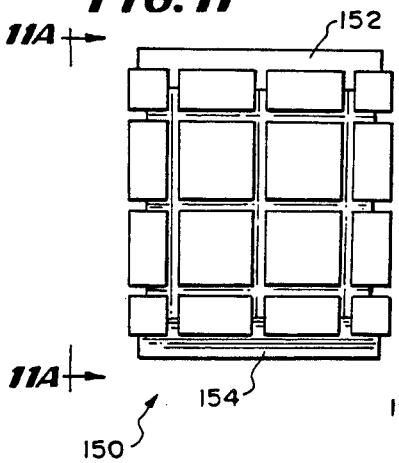
FIG. 11 is a top plan view of a building block piece with ribs on opposite side edges thereof and with slots therein, such piece being generally square in two dimensions.
Figure 11A:
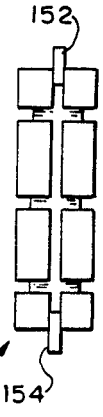
FIG. 11A is a side view of the piece shown in FIG. 11 and shows the piece being rectangular in another two dimensions.

In FIG. 11 there is shown another building block piece 150 which is generally square having a dimension of 1 ½ inches by 1 ½ inches with ribs 152 and 154 on opposite sides thereof. A side edge view of the building block piece 150 is shown in FIG. 11A and is taken along line 11A—11A of FIG. 11.

Figure 12:
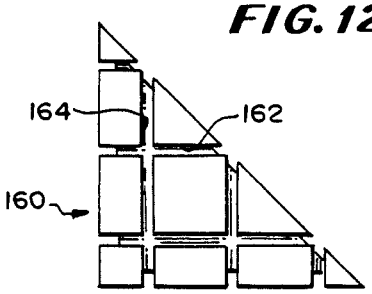
FIG. 12 is a side elevational view of a triangularly shaped building block piece with 45°-45°-90° angles and constructed according to the teachings of the present invention.

In FIG. 12 is illustrated a triangular building block piece 160 which has 45°-45°-90° angles and has right angle sides of 1 ½ by 1 ½ inch to provide the configuration shown. Here the piece 160 has three longitudinal slots 162 and three transverse or lateral slots 164. This piece 160 has slots in the leg side edges and hypotenuse side edge thereof.

Figure 13:
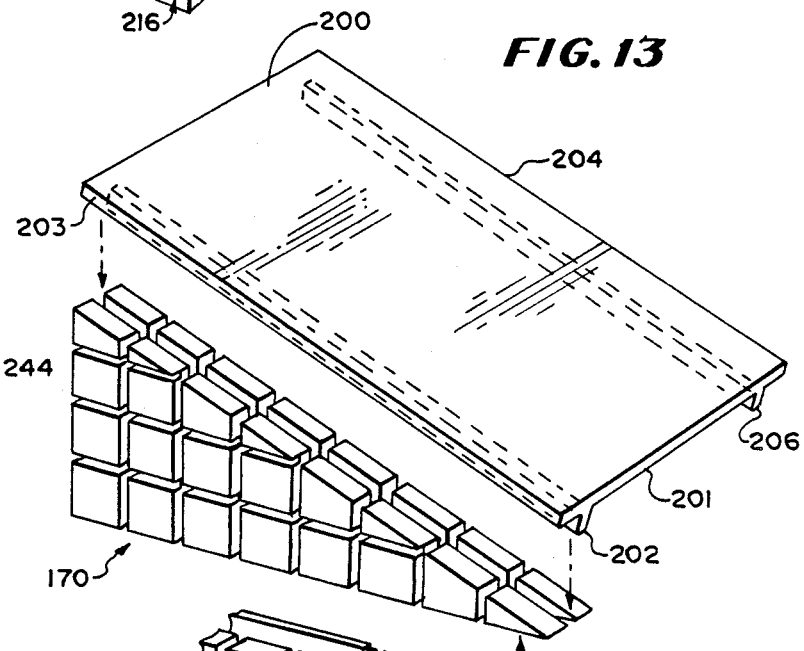
FIG. 13 is an exploded perspective view of an upper corner portion of a building and shows another triangularly shaped building block piece with 30°-60°-90° angles, a flat panel with spaced apart elongate ribs on the underside thereof for forming part of a roof, a portion of an elongate building block piece similar to the piece shown in FIG. 6 positioned to be connected to the underside of the triangularly shaped piece, and a portion of a rectanqular building block piece similar to the piece shown in FIG. 10 positioned to be connected to the underside of the triangularly shaped piece.

Another triangular piece 170 is shown in FIG. 13 and has 30°-60°-90° angles. The piece 170 has a length on the long leg thereof of 4 inches. Also, as shown, the triangular angular piece 170 has a slot on the hypotenuse side thereof and although not shown and hidden from view, slots in the side edges thereof.

Further in FIG. 13 there is shown an elongate building block piece 180 similar to the building block piece 100 shown in FIG. 6 and a rectangular building block piece 190 similar to building block piece 140. These building block pieces 180 and 190 are shown positioned for connection to the long leg side of the triangular piece 170.

Also there is shown in FIG. 13 another building block piece 200 of a toy building block kit constructed in accordance with the teachings of the present invention. This piece 200 is different from the other pieces in that it is a flat panel shaped piece 200 which is used for forming a roof or floor of a building constructed with the various building block pieces of the present invention. For this purpose, one side 201, which is facing downwardly in FIG. 13, has two longitudinally extending ribs 202 and 204 adjacent each side edge 203 or 204 thereof.

It will be appreciated that the building block pieces 170, 180, 190 and 200 are positioned as exploded parts of the corner of a building and, of course, one of the utilizations of the pieces of a toy building block kit constructed according to the teachings of the present invention is to construct various building structures.

Figure 14:
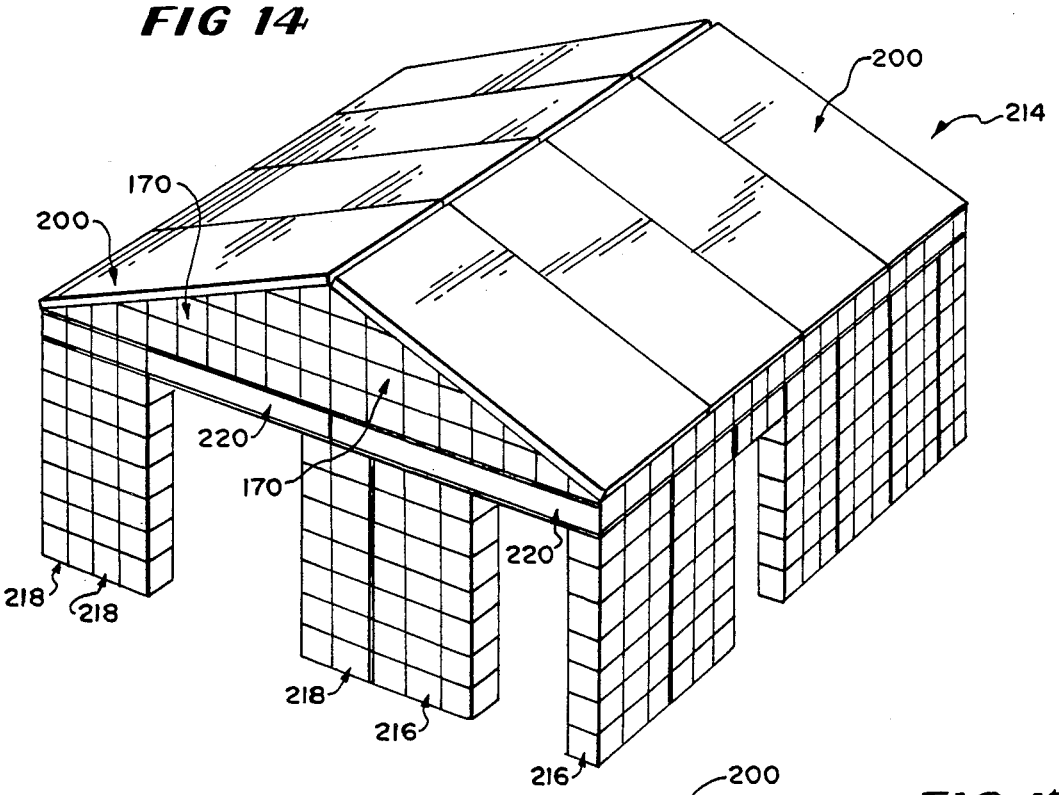
FIG. 14 is a perspective view of a simple building constructed with the building block pieces of the present invention.

In this respect, a simple building structure 214 is shown in FIG. 14. Here the building structure 214 is made up of a plurality of different pieces such as rectangular pieces 216 which are shown as being 3 ½ inches by 1 ½ inches wide, rectangularpieces 218 which are shown as being 1 inch wide by 3 ½ inches long, two elongate pieces 220 which are shown as being approximately 5 inches long, two triangular pieces 170 and a plurality of flat panel pieces 200.

Figure 15:
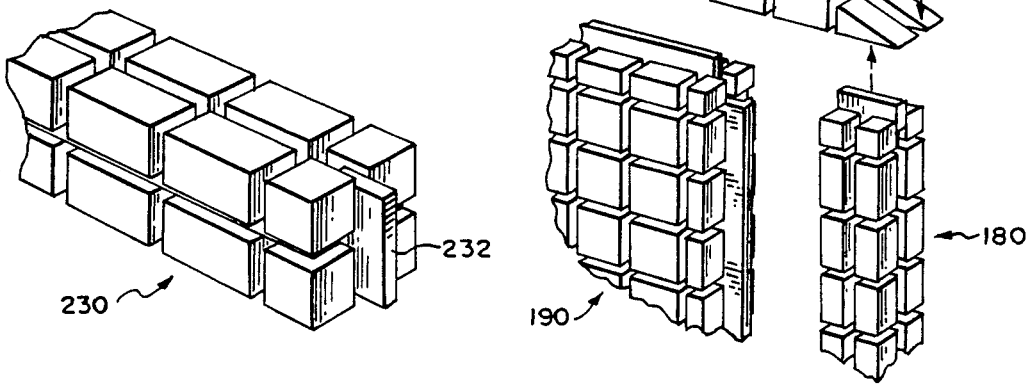
FIG. 15 is a fragmentary perspective view of an end of an elongate piece having a rib thereat like the piece shown in FIG. 6.

The elongate pieces 220 can have different end formations and one end piece 230 with one type or one end formation is shown in FIG. 15. Here an end tab 232 is provided at the end of the elongate piece 230.

Figure 16:
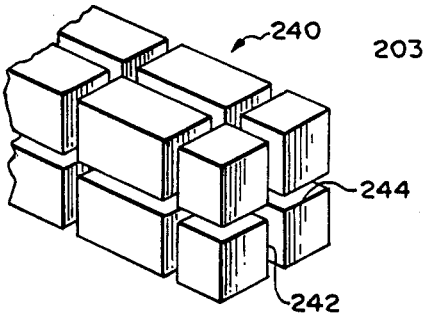
FIG. 16 is a fragmentary perspective view of a slotted end for an elongate piece of the type as shown in FIGS. 6 and 7.

Another elongate piece 240 is shown in FIG. 16 and instead of having an end rib 232, it has two transverse end slots 242 and 244.

Although various sizes of building block pieces have been illustrated in FIGS. 1-16, and described in reference to the descriptions of FIGS. 1-16, it is contemplated that each kit will have a plurality, e.g., 10 or 20, of each particular piece. Such pieces can have, for example, configurations and dimensions of 1 inch by 1 inch by ½ inch, or 1 inch by 2 inches by ½ inch, and with ribs on each end, or one end rib, or ribs on adjacent sides.

Also it is contemplated that triangular pieces of, say for example, 1 inch by 2 inches, 30°-60°-90° right angle member piece, and a 1 inch by 1 inch 45° angle piece can be provided.

Optional pieces will be 4 inches by 4 inches by ½ inch, 4 inches by 2 inches by ½ inch, or 2 inches by 2 inches by ½ inch.

It is further contemplated that the elongate pieces can provide struts for different structures and can have dimensions of ½ inch by ½ inch by 4 inches long, by 8 inches long, by 12 inches long, or by 16 inches long.

With respect to the panel pieces 200, it is contemplated that such pieces can have a variety of dimensions such as 2 inches by 4 inches, 4 inches by 4 inches, 8 inches by 8 inches, 12 inches by 12 inches, or 16 inches by 16 inches with a thickness of approximately ⅛ inch.

Additionally, it is contemplated that special corner pieces can be provided with a generally L shape and with dimensions of ½ inch by ½ inch with one leg of the L being 1 inch long and the other leg of the L being 1 inch long.

It will be appreciated of course, that a toy building block kit made according to the teachingsof the present invention for building model buildings will have certain types of pieces having certain dimensions, whereas a kit made according to the teachings of the present invention for building girder type structures or machines will have different types of pieces and a different plurality of each piece.

Figure 17:
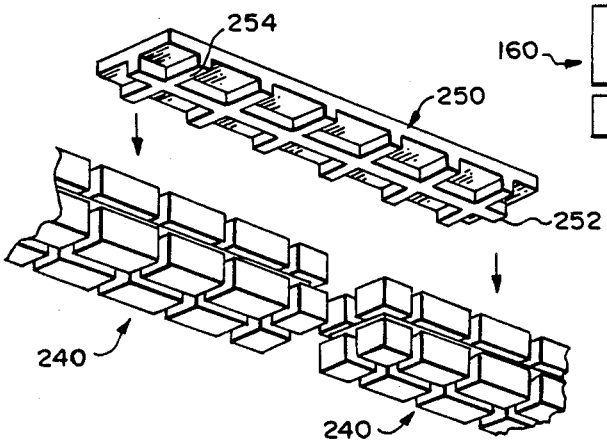
FIG. 17 is an exploded fragmentary perspective view of the ends of two elongate pieces which are held together by an elongate flat half piece straddling the elongate pieces, the flat half piece having a longitudinal rib and laterally extending lateral ribs thereon and is shown on the second sheet of drawings with FIGS. 6–12.
Figure 18:
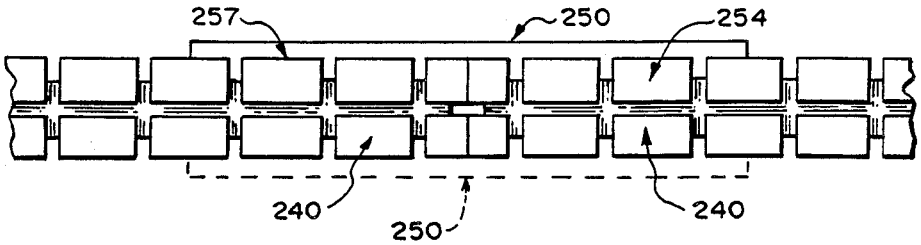
FIG. 18 is a side view of the pieces shown in FIG. 17 after they are secured together and shows in phantom an additional elongate flat half piece with ribs thereon received in slots on the opposite side of the elongate pieces from the first elongate flat half piece.

In addition, a number of specialty pieces can be provided for different purposes. For example, in FIG. 17 there are illustrated two abutting elongate pieces 240 which have slotted ends and a special flat elongate ribbed building block piece 250 which is adapted to made with side portions of and couple the abutting ends of the elongate pieces 240. For this purpose, the flat elongate piece 250 has a longitudinal rib 252 extending the length of the piece 250 and a plurality, in this instance six, transverse ribs 254. As shown in FIG. 18, the two elongate pieces 240 are brought into end to end abutting engagement with each other and the flat rib piece 250 is pressed into adjacent sides 257 and 259 of the elongate pieces 240 adjacent their abutting ends.

If desired, to provide further structural support, another flat elongate piece 250, shown in phantom in FIG. 18, can be fixed to the abutting end portions of the elongate pieces 240 on the opposite side of the flat enlongate piece 250.

Figure 19:
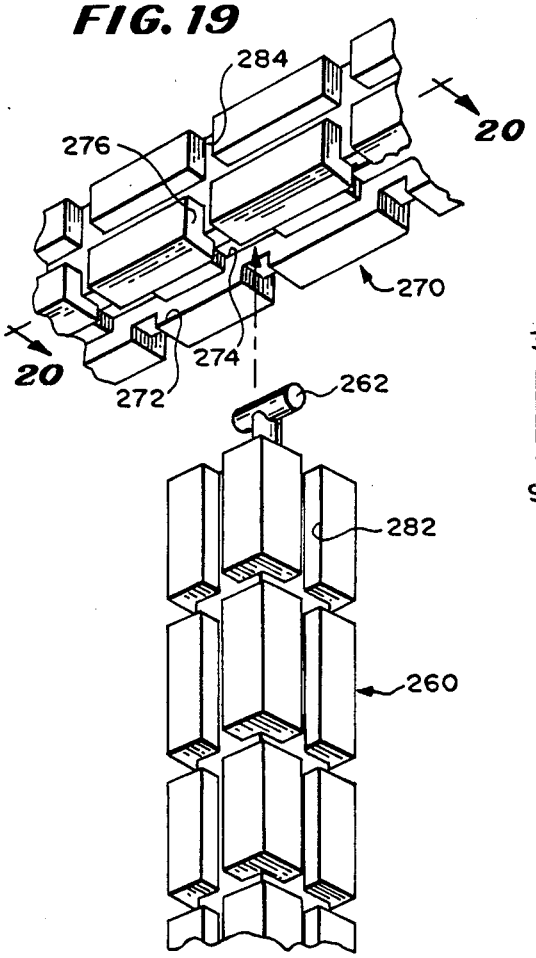
FIG. 19 is a fragmentary perspective view of a T connection between two elongate pieces and shows one elongate piece having a T shaped connector at one end thereof and another elongate piece having an opening in the side thereof for receiving the T shaped connector.
Figure 25:
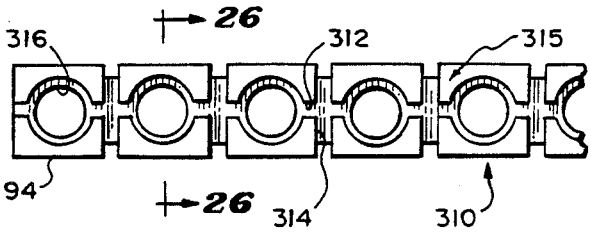
FIG. 25 is a side view of another type of elongate building block piece which has bores extending therethrough each adapted to receive a journal member of the type shown in FIGS. 27 and 28 and is shown on the fourth sheet of drawings.
Figure 20:
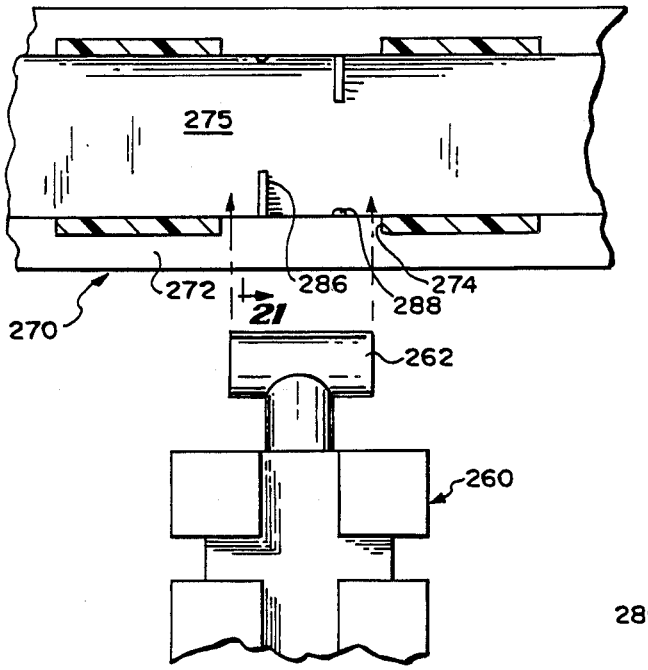
FIG. 20 is a sectional view through the exploded T connection shown in FIG. 19 and is taken along line 20—20 of FIG. 19.
Figure 21:
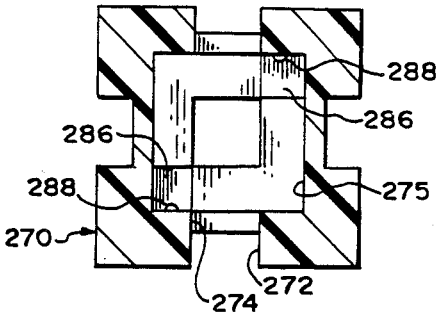
FIG. 21 is a sectional view of one of the elongate pieces shown in FIG. 20 and is taken along line 21—21 of FIG. 20.
Figure 22:
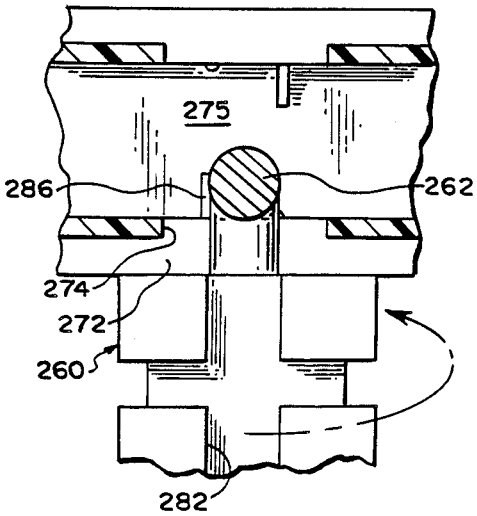
FIG. 22 is a fragmentary sectional view of the completed T connection and shows a fragmentary portion of one elongate piece with an opening therein in section and the T connector of the other elongate piece received therein.

Another form of interconnection between two elongate pieces is shown in FIG. 19-22. As shown in FIG. 19, an elongate building block piece 260 is provided with a T connector 262 at one end thereof. This T connector 262 is adapted to couple with another elongate member 270 shown above the member 260. More specifically, the elongate building block piece 270 has a longitudinal slot 272 therein and an opening 274 at the bottom of the slot opening into an interior cavity 275 within the elongate piece 270. As shown, this opening 274 straddles a transverse slot 276. In this way, the elongate piece 260 and more particularly the connector 262 at the end thereof, can be inserted into the longitudinal slot 272 through the opening 274 and then rotated so that a longitudinal slot, e.g., slot 282 on piece 260 as shown in FIGS. 19 and 22 will be aligned with a transverse slot 284 in the elongate building block piece 270 as shown in FIG. 19.

FIGS. 20, 21 and 22 depict sectional view of the piece 270. Here the communication through slot 272 and opening 274 to interior cavity 275 is shown which enables the T connector 262 to extend into the piece 270. Within the cavity 275 there is provided a stop 286 and a detent 288. With this construction, after the T connector 262 is inserted through the opening 274 it can be rotated past the detent 288 and into contact with the stop 286. Such position of the T connector 262 is shown in FIG. 22.

As shown in FIGS. 20 and 21, stops 286 are generally square plate shaped members.

Figure 23:
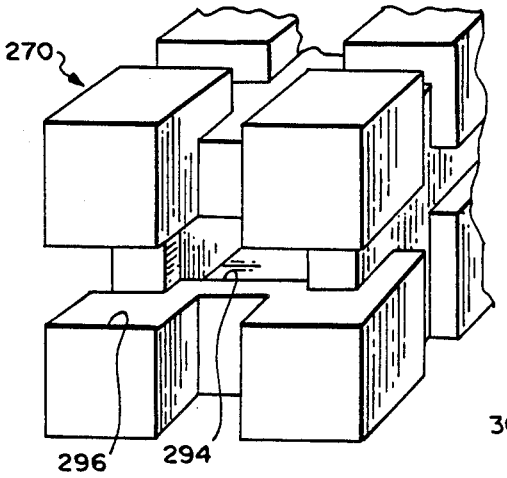
FIG. 23 is a fragmentary perspective view of an end of one elongate piece and shows an opening in the end thereof for receiving the T connector of the elongate piece shown in FIGS. 19, 20 and 22.

If desired, the elongate building block piece 270, or other similar piece, can be formed with an opening 294 at the bottom of a transverse end slot 296 as shown in FIG. 23. In this way, an end to end construction can be made between an elongate building block piece 260 with a T connector at the end thereof and an elongate building block piece 270 having an opening 294 in the end thereof.

Figure 24:
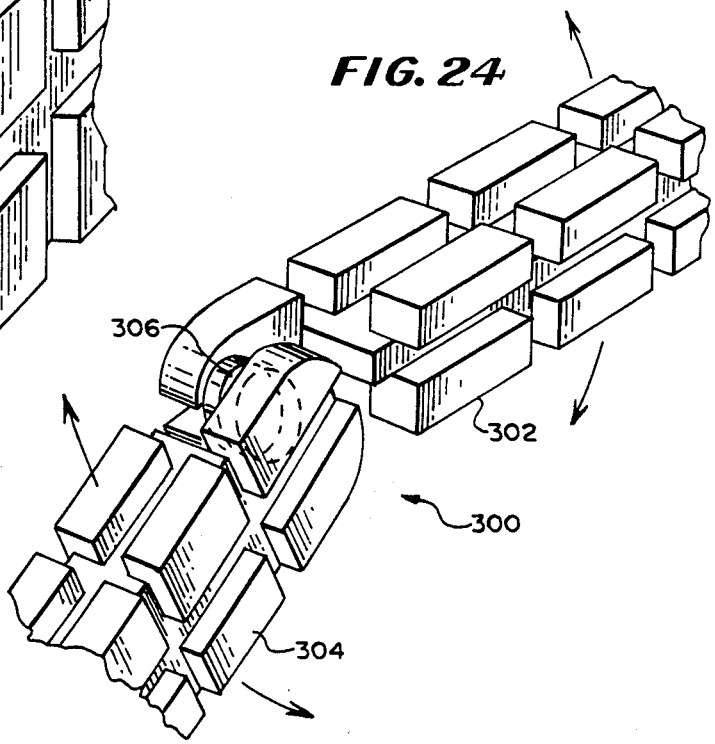
FIG. 24 is a fragmentary perspective view of an elongate piece having a hinge intermediate the ends thereof to permit pivoting of one portion of the elongate piece relative to another portion of the elongate piece

In FIG. 24 there is illustrated another elongate special building block piece 300 which includes a first portion 302 and a second portion 304 which are hinged together by a hinge formation 306 as shown.

Figure 26:
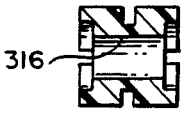
FIG. 26 is a sectional view of the elongate building block piece shown in FIG. 25, is taken along line 26—26 of FIG. 25 and is shown on the fourth sheet of drawings with FIGS. 18, 19, 25, 27 and 28.

In FIGS. 25–28 there is illustrated still another special elongate building block piece 310 having a special purpose function. Here the elongate building block piece 310 is provided with a longitudinal slot 312 and a plurality of transverse slots 314. In addition, in each square formation 94 on one side 315 of the piece 310 there is provided a countersunk throughbore 316 which extends laterally through the building block piece 310 and is countersunk at one end as shown in FIG. 26. The other sides of the elongate building block piece 310 have longitudinal slots such as longitudinal slots 318 shown in FIG. 27.

Figure 27:
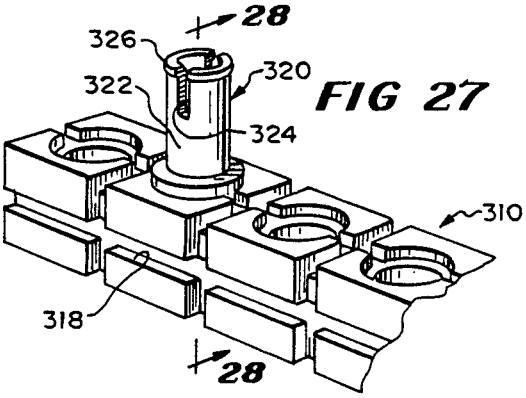
FIG. 27 is a fragmentary perspective view of the building block piece shown in FIG. 25 with a journal member mounted in one of the bores, and is shown on the fourth sheet of drawings with FIGS. 18, 19, 25, 26 and 28.
Figure 28:
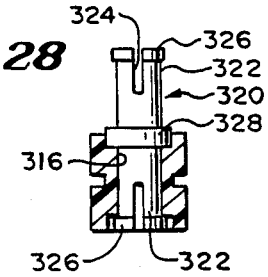
FIG. 28 is a sectional view taken along line 28—28 of FIG. 27, shows the journal member not in cross section received in one of the bores in the elongate piece shown in FIG. 25 and is shown on the fourth sheet of the drawings with FIGS. 18, 19, 25, 26 and 27.

The elongate building block piece 310 with the countersunk throughbores 316 is adapted to have mounted in any one of the throughbores 316 a journal piece 320 shown in FIGS. 27 and 28.

As best shown in FIG. 28, each of the journal pieces 320 has identical opposite ends 322 which are slit at 324 so as to be deflectable and has a rim 326 at each end which can be snap fitted through a bore 316 and into a countersunk end thereof. Intermediate the ends 326 is an annular collar portion 328 which, when one end 322 of the journal piece 320 is inserted through a throughbore 316 and engages in a countersunk end 316 after the deflectable rim 326 snaps into place, will fit into the other countersunk end of the bore 316 as best shown in FIG. 28.

The journal piece 320 facilitates the mounting of wheels and/or axles to an elongate piece 310 for building a machine, vehicle, or apparatus having moving parts such as the automobile 430 shown in FIG. 37. 10 A special three way connecting piece 330 is shown in FIG. 29 and includes a base 332 having a flat bottom end edge 334 with a rib 336 thereon and a mounting plate portion 38 extending upwardly from the base portion 332 and having two pivotable members 340 pivoted thereto. Each pivotable member 340 has a flat end edge 342 with a rib 344 as shown.

In FIG. 30 is shown a special "telescopic" elongate piece 350. Here the telescopic piece 350 has one portion 352 which has a bar 354 extending therefrom and which can be fixed to the piece 352 or slidable in a longitudinal opening 356 therein and fixed by means of a pin 358 which extends through a transverse opening shown in phantom in FIG. 3D through the elongate piece 352 and one of several openings 360 in the bar 354 when such opening 360 is aligned and in registry with a transverse opening (hidden from view) in the elongate portion 352. The telescopic piece 350 includes another portion 362 which has a longitudinal opening (hidden from view) in which the bar 354 is received. Again, a pin 358 can be inserted through a transverse opening in the portion 352 and through an aligned opening 360 to fix the position of the bar 354 within the piece 352. In this way the length of the telescopic piece 350 can be adjusted by the telescoping of the bar 354 fixed to portion 352 within the portion 362.

In FIG. 31 is shown another special elongate building block piece 370 having a ball 372 at the end thereof for being received in a socket in another piece which can be an elongate piece or other type piece and where the socket can be formed in the end or in the side of the other piece.

Still another special elongate building block piece 380 is shown in FIG. 32. Here the piece 380 has a bayonet 382 pivotally mounted to one end thereof. Such bayonet 382 is adapted to be received into a cylindrical opening 384 in the end of another elongate building block piece 390.

In FIG. 33 is illustrated a cylindrical or barrel shaped piece 390 which has a central throughbore 392 and axially extending slots 394 on a cylindrical periphery 399 thereof. These slots 394 are adpated to receive a rib 232 at the end of an elongate piece 230 as shown.

It will be appreciated that the cylindrical or barrel shaped piece 390 enables one to make a ferris wheel or other kind of windmill structure utilizing elongate pieces 230 therewith.

A modified end of still another elongate piece 400 is illustrated in FIG. 34 and generally identified by the reference numeral 401. Here the piece 400 has a rib 402 with a pin 403 extending from the end 406 thereof.

Two further specialty elongate pieces 410 and 412 are shown in FIGS. 35 and 36. Here to enhance lateral strength against bending at a joint between two elongate pieces 410 and 412, such as is obtained with the flat pieces 250 in the joined ends of the pieces 240 shown in FIGS. 17 and 18, the specially configured elongate pieces 410 and 412 are provided. As shown, the elongate piece 410 has extending from one end thereof a flat extension 414 which has a cross member 416 at the end thereof so as to form a flat extension 414 with a T shaped cross section.

The elongate piece 412 is then provided with a slit 424 extending laterally through one end of the piece 412 that mates with a lateral or cross slit 426 so that the slits 424 and 426 have a T shaped cross section identical to the cross section of the flat extension 414 with the cross end member 416.

As shown by the arrow in FIG. 35, the piece 410 is moved laterally into connection with the aligned slits 424 and 426 to connect piece 410 to the piece 412. The joined ends of the pieces 410 and 412 are shown in FIG. 36.

In FIG. 37 is illustrated an automobile 430 constructed with various pieces of a toy building block kit made in accordance with the teachings of the present invention.

Here it will be apparent that two elongate pieces 310 are utilized on the bottom side of the automobile which have bores 316 for receiving journal pieces 320 for mounting wheels 432 to the vehicle. Such wheels can be provided with a kit or purchased separately from a hobby store. Also triangular pieces 160 are used for forming a windshield. A roof is formed by a piece 120, a front gill is created with small 30°–60°–90° triangular pieces 170 and a swept back rear of the automobile is created with larger sized 30°–60°–90° pieces 170.

It is to be appreciated that with a plurality of a number of differently configured building block pieces made according to the teachings of the present invention, one can build a wide variety of structures in addition to building an automobile. For example, girder type structures, ferris wheels, airplanes, ships, helicopters, etc., can be constructed from pieces of varying kits made and assembled according to the teachings of the present invention.

As a further example of the uses that can be made of a kit, there is illustrated in FIGS. 38 and 39 corner portions of an intricate or elaborately designed house which requires other specialty pieces as well as pieces made according to the teachings of the present invention.

In FIG. 38 is shown the backside of a corner 450 of an elaborately configured building and shows a sidewall 452 which is stepped so as to provide a stepped inclined edge 454 on which will rest a flat panel piece similar to a panel piece 200 shown in FIGS. 13 and 14 for forming a roof.

Also there is shown elongate building block pieces 456 and 458 which are utilized for forming flooring supporst, pieces 456, and vertical support beams, pieces 458. Additionally, there is shown a panel member 460 which can be used for forming flooring for the building. This panel 460 can be particularly sized and designed for use with the kit or can be purchased separately from a hobby shop.

In FIG. 39 there is shown a front corner 470 of a building which can be part of the building made with the corner 450 shown in FIG. 39. Here it will be seen that specialty pieces such as an elaborate window frame 472, frame windows 474 and a special door and door frame 476 are provided.

Also shown in FIG. 38 are triangular panel pieces 480 which have the shape of isosceles triangles. These panel portions 480 can be in the shape of an equilateral triangle if desired. The pieces 480 are adapted to be positioned over a tower or column 482 to form a peaked roof 484 or gable or cornice.

Such triangular pieces can be provided with a building block kit made according to the teachings of the present invention or purchased separately from a hobby shop.

Referring now to FIGS. 40 and 41 there is illustrated therein a modified construction of a generally rectangular building block piece 490. Here the building block piece 490 is shown without ribs and instead has longitudinal slots 491 and 492 on adjacent sides thereof and transverse slots 493 on the narrow sides of the building block piece 490. On the wider sides of the building block piece are provided longitudinal slots 494 and transverse slots 495. Here, instead of having generally square formations 94 the building block piece is made with square formations 496 which have a cavity 497 therethrough so as to minimize the amount of material needed to make the building block piece 490.

If desired, the amount of material can be further reduced by eliminating the walls of material between the cavities 497. This would involve cutting away the wall portion between the lines of cut 498 and 499 shown in FIG. 40.

It will be appreciated from the foregoing description that modifications can be made to the building block pieces of the present invention without departing from the teachings of the present invention. For example, in FIG. 42 is shown modified building block pieces 500 and 502. Here the building block piece 500 has generally square shaped bosses 503 extending from the various sides thereof to form a longitudinal slot 504 and a plurality of transverse slots 505 therebetween.

The piece 502 is formed with a longitudinal rib 506 and transverse ribs 507 extend from and on either side of the longitudinal rib 506 on side 508 of the piece 502. In this modified embodiment of the building block pieces 500 and 502 of the present invention, all sides of the building block piece 500 are shown with bosses 503 and all sides of the building block piece 502 are shown with ribs 506 and 507. However, it is to be appreciated that various building block pieces of this type can be provided where, for example, one end such as end 509 of a piece 500 has square bosses 503 thereon and the opposite end of such piece can have ribs 506 and 507 therein as shown on end 510 of building block piece 502. Then, of course, one side of building block piece 500 such as side 512 of piece 500 can have a plurality of bosses 503 thereon whereas the opposite side thereof would only have ribs 506 and 507 therein such as shown on side 514 of building block pieces 502.

From the foregoing description it will be apparent that the building block pieces of the present invention and a kit comprising a plurality of one or more pieces provides a kit which enables someone, such as a young boy or girl, playing with the kit, to construct a wide variety of structures from three dimensional sculptures to building and cars and then to ships, airplanes, and complex machines. In this respect, the building block pieces of the present invention and the various kits that can be assembled with same provide a number of advantages, some of which have been described above and others of which are inherent in the invention. Accordingly, the scope of the invention is only to be limited as necessitated by the accompanying claims.

I claim:

1. For use in a toy building block kit, a first three dimensional building block piece having on at least one side thereof at least one longitudinal slot and at least one intersecting transverse slot 90° to said longitudinal slot without any slots at the corner edges of the building block piece so as to form at least four two dimensional square corner formations on that one side of said first building block piece, each square corner formation having side dimensions equal to X and each slot having a width to $(\frac{2}{3})X$, and a second three dimensional building block piece having on at least one side thereof a rib extending therefrom, sized, configured and dimensioned to be received in one of said slots in said first building block piece.

2. The building block pieces of claim 1 wherein said first building block piece has at least two transverse slots in at least one side thereof.

3. The building block pieces of claim 1 wherein said first building piece has at least two longitudinal slots in at least one side thereof.

4. The building block pieces of claim 1 wherein said first building block piece has a given thickness and said second building block piece has the same thickness.

5. The building block pieces of claim 4 wherin said first building block piece has two end sides, four elongate sides, and two or more transverse slots in each of the four elongate sides thereof, is elongate, and is generally square in one cross section thereof.

6. The building block pieces of claim 5 wherein said elongate piece has a rib at one end thereof.

7. The building block pieces of claim 5 wherein said elongated piece has a rib at both ends thereof.

8. The building block pieces of claim 5 wherein said elongate piece has a rib extending along one side thereof.

9. The building block pieces of claim 5 wherein said second building block piece has two end sides, four elongate sides and two or more transverse slots in each of the four elongate sides thereof, is elongate, and is generally square in one cross section thereof, and said two pieces are combined with an elongate first half piece capable of straddling the abutting ends of elongate pieces, the flat half piece having a longitudinal rib and laterally extending lateral ribs thereon for being received in longitudinal and lateral slots in said elongate pieces.

10. The building block pieces of claim 5 wherein said elongate piece has a T connector on one end thereof and said second piece has an opening in a slot thereof for receiving said T connector.

11. The building block pieces of claim 10 wherein said opening is in a side of said second piece which is an elongate piece.

12. The building block pieces of claim 10 wherein said slot is in an end of said second piece which is an elongate piece.

13. The building block pieces of claim 5 wherein said first elongate piece has two separate portions and a hinge interconnecting same.

14. The building block pieces of claim 5 wherein said elongate piece has a plurality of spaced apart bores extending therethrough each bore being adapted to receive a journal member for mounting an axle.

15. The building block pieces of claim 1 wherein said second piece is a three way connecting piece having a base portion with a rib extending downwardly therefrom and two connecting portions each pivoted to the base portion and each having a rib at an outer end thereof.

16. The building block pieces of claim 5 wherein said elongate piece has two portions which are telescopically connected by means of a bar which is fixed to a one portion, which has apertures therein and which is slidably received within the other portion that has an opening therethrough transverse to said bar and which is held in place by means of pins extending through said opening in said other portion and an aperture in said bar in registry with said opening.

17. The building block pieces of claim 5 wherein said elongate piece has a ball at the end thereof for forming a ball joint connection with another elongate piece having a ball socket in an end thereof.

18. The building block pieces of claim 5 wherein said elongate piece has a pivoted bayonet at one end and said second piece has an axial opening at one end thereof for receiving said bayonet.

19. The building block pieces of claim 6 combined with a cylindrical building block piece having spaced apart axially extending slots on the outer periphery thereof for receiving a rib on the end of said elongate piece.

20. The building block pieces of claim 5 wherein said elongate piece has a flat extension at an end thereof, said flat extension hvaing a T shaped cross section and said second piece has a T shaped slot extending therethrough at an end thereof for laterally receiving said T cross section flat extension of said first piece.

21. The building block pieces of claim 4 wherein said first piece has said given thickness in one direction and is generally rectangular in a plane normal to said direction of said thickness.

22. The building block pieces of claim 21 wherein said first piece has at least three longitudinal slots and at least three transverse slots in a generally rectangular side thereof so as to form four small corner formations in each corner thereof, eight rectangular formations, two on each side edge thereof, and four larger corner formations in the center thereof situated between the longitudinal slots and the transverse slots.

23. The building block pieces of claim 22 wherein said longitudinal slots and said traverse slots in said generally rectangular side form said generally rectangular side of said first piece with a generally waffle pattern.

24. The building block pieces of claim 1 wherein said first piece is generally triangular in one dimension.

25. The building block pieces of claim 24 wherein said triangular piece has a 30°–60°–90° angular configuration.

26. The building block pieces of claim 26 wherein said triangular piece has a 45°–45°–90° angular configuration.

27. The building block pieces of claim 1 wherein said second piece is a panel piece which has said at least one rib extending from said one side thereof.

28. The building block pieces of claim 27 wherein said panel piece has a second rib parallel spaced to said first rib on said one side thereof, said ribs being located on a flat surface of said panel piece adjacent side edges of said panel piece.

29. The building block pieces of claim 27 wherein said panel piece has a rectangular dimension consisting of one of the following dimensions: 1 inch by 2 inches; 2 inches by 2 inches; 2 inches by 4 inches; 4 inches by 4 inches; 2 inches by 6 inches; or 2 inches by 8 inches.

30. The building block pieces of claim 4 wherein said first piece has a thickness of approximately ½ inch in two dimensions and has a length between 1 inch and 12 inches.

31. The building block pieces of claim 1 wherein said rib has a thickness of approximately ⅛ inch and a depth of approximately ⅛ inch in a building block piece.

32. The building block pieces of claim 2 wherein said small corner formation has a dimension of 3/16 inch by 3/16 inch, the rectangular formations having a dimension of 6/16 inch by 3/16 inch and said large square formations having a dimension of 6/16 inch by 6/16 inch.

33. The building block pieces of claim 1 wherein said first and second pieces are generally cubical in shape with at least four longitudinal slots and four transverse slots on each side of each cube shaped piece, and with at least one rib fixed in one slot on one side of said second piece to facilitate interconnecting said first and second pieces together.

34. The building block pieces of claim 1 wherein said first piece has half the thickness of said second piece, is generally flat and has ribs on one side thereof opposite transverse slots on the other side thereof.

35. The building block pieces of claim 1 wherein said first piece has a thickness of approximately ½ inch and rectangular dimensions consisting essentially of one of the following dimensions: 1 inch by 1 inch, 2 inches by 2 inches, 1 inch by two inches, 2 inches by 4 inches, 4 inches by four inches and 2 inches by 6 inches.

36. The building block pieces of claim 1 wherein said first building block piece has hollow cavities extending therethrough to reduce the amount of material in said first building block piece.

37. The building block pieces of claim 1 wherein at least one of said pieces is made of two half shell piece portions which are adhered together such as by solvent bonding to form a hollow building block piece.

38. The building block pieces of claim 1 wherein said second piece has at least one longitudinal rib and at least one transverse rib interconnected with each other and sized to fit in said slots in said first piece.

39. The building block pieces of claim 1 wherein said first building block piece has in one side thereof at least three longitudinally extending parallel spaced slots and at least three intersecting parallel spaced transverse slots 90° to said longitudinal slots, said slots being spaced from each other in such a manner as to form a waffle pattern on said one side of said first building block piece without slots at the corner edges of said first building block piece and with four corner formation separated by eight two dimensional rectangular formations each having a length 2X and a width X and the center area of said one side having four two dimensional square formations with side dimensions equal to 2X.

* * * * *